US011295639B2

(12) United States Patent
Werner et al.

(10) Patent No.: US 11,295,639 B2
(45) Date of Patent: Apr. 5, 2022

(54) LUMINOUS ADVERTISEMENT ASSEMBLY AND LUMINOUS ADVERTISEMENT

(71) Applicant: ELKAMET KUNSTSTOFFTECHNIK GMBH, Biedenkopf (DE)

(72) Inventors: Torsten Werner, Dautphetal (DE); Bjoern Grunert, Biedenkopf (DE); Markus Wewior, Biedenkopf (DE)

(73) Assignee: ELKAMET KUNSTSTOFFTECHNIK GMBH, Biedenkopf (DE)

( * ) Notice: Subject to any disclaimer, the term of this patent is extended or adjusted under 35 U.S.C. 154(b) by 0 days.

(21) Appl. No.: 17/276,824

(22) PCT Filed: Sep. 11, 2019

(86) PCT No.: PCT/EP2019/074191
§ 371 (c)(1),
(2) Date: Mar. 17, 2021

(87) PCT Pub. No.: WO2020/058056
PCT Pub. Date: Mar. 26, 2020

(65) Prior Publication Data

US 2021/0350728 A1 Nov. 11, 2021

(30) Foreign Application Priority Data

Sep. 19, 2018 (DE) ..... 10 2018 122 985.2

(51) Int. Cl.
*G09F 13/04* (2006.01)
*F21V 17/10* (2006.01)
(Continued)

(52) U.S. Cl.
CPC ..... *G09F 13/0413* (2013.01); *E06B 3/5445* (2013.01); *F21V 17/104* (2013.01);
(Continued)

(58) Field of Classification Search
CPC .. G09F 13/0413; G09F 13/0445; G09F 13/04; G09F 13/0404; E06B 3/5436;
(Continued)

(56) References Cited

U.S. PATENT DOCUMENTS 4,467,405 A * 8/1984 Weber ..... F21V 1/06 362/352
2006/0075670 A1* 4/2006 Brinkman ..... G09F 3/204 40/666
(Continued)

FOREIGN PATENT DOCUMENTS

DE 828309 C 1/1952
DE 2344943 B * 2/1975 ..... G09F 13/0404
(Continued)

OTHER PUBLICATIONS

Burkardsmaier Erwin Eugen, "Housing, in particular for light boxes or light blocks serving as advertising media", Feb. 6, 1975, Machine Translation of DE2344943B1•Feb. 6, 1975, 11 pages.*
(Continued)

*Primary Examiner* — Alan B Cariaso
(74) *Attorney, Agent, or Firm* — Leydig, Voit & Mayer, Ltd.

(57) ABSTRACT

A luminous advertisement assembly includes a side wall, a transparent and/or translucent front plate and a profiled connecting element. The profiled connecting element has a first connecting region to which the front plate is fixed, and a second connecting region to which the side wall is fixed. The first connecting region is configured as a receptacle having a first leg and a second leg between which the front plate is received. A latching hook is disposed on the first leg and is configured to fix the front plate in the receptacle. A
(Continued)

recess is disposed in the front plate, and the latching hook of the profiled connecting element engages in the recess of the front plate.

18 Claims, 8 Drawing Sheets

(51) Int. Cl.
*F21V 17/18* (2006.01)
*E06B 3/54* (2006.01)

(52) U.S. Cl.
CPC ..... *F21V 17/18* (2013.01); *G09F 13/0445* (2021.05); *G09F 13/0404* (2013.01)

(58) Field of Classification Search
CPC ..... E06B 3/5445; F21V 17/104; F21V 17/16; F21V 17/162; F21V 17/18
See application file for complete search history.

(56) References Cited

U.S. PATENT DOCUMENTS

2008/0259573 A1 10/2008 Besserer
2011/0285177 A1* 11/2011 Flammer ..... B60J 10/70 296/208
2013/0074384 A1 3/2013 Fenkart et al.
2014/0321105 A1* 10/2014 Meyer ..... A47F 5/0068 362/125

FOREIGN PATENT DOCUMENTS

| | | | | | |
|---|---|---|---|---|---|
| DE | 9013738 | U1 | 2/1991 | | |
| DE | 102004050498 | A1 | 8/2006 | | |
| DE | 202008016217 | U1 | 4/2009 | | |
| DE | 102017000924 | A1 | 8/2018 | | |
| EP | 2119864 | A2 * | 11/2009 | ..... | E06B 3/5454 |
| EP | 2479371 | A2 * | 7/2012 | ..... | E06B 3/5454 |
| EP | 2997565 | A1 | 3/2016 | | |
| KR | 101256802 | B1 | 4/2013 | | |
| KR | 20140024991 | A | 3/2014 | | |
| KR | 20160091713 | A | 3/2016 | | |
| RU | 2560311 | C2 | 8/2015 | | |
| SU | 20440 | A1 | 4/1931 | | |
| WO | 2014186434 | A1 | 11/2014 | | |

OTHER PUBLICATIONS

Hui-Yong Park, "Publication No. 10-2016-0091713", Aug. 3, 2016, KIPO Machine Translation, 16 pages.*
Hui-Yong Park, "Registration No. 10-1256802", Apr. 23, 2013, KIPO Machine Translation, 21 pages.*
Jeong-Min Lee, "Publication No. 10-2014-0024991", Mar. 4, 2014, KIPO Machine Translation, 21 pages.*

* cited by examiner

LUMINOUS ADVERTISEMENT ASSEMBLY AND LUMINOUS ADVERTISEMENT

CROSS-REFERENCE TO PRIOR APPLICATIONS

This application is a U.S. National Phase Application under 35 U.S.C. § 371 of International Application No. PCT/EP2019/074191, filed on Sep. 11, 2019, and claims benefit to German Patent Application No. DE 10 2018 122 985.2, filed on Sep. 19, 2018. The International Application was published in German on Mar. 26, 2020 as WO 2020/058056 under PCT Article 21(2).

FIELD

The invention relates to a luminous advertisement assembly including an in particular opaque side wall, a transparent and/or translucent front plate and a profiled connecting element for connecting the front plate to the side wall, the profiled connecting element having a first connecting region to which the front plate is fixed, and a second connecting region to which the side wall is fixed, the first connecting region being configured as a receptacle having a first leg and a second leg between which the front plate is received. The receptacle may in particular be U-shaped or V-shaped.

BACKGROUND

For labeling or advertising purposes, luminous advertisements are often used in the form of strikingly illuminated images, such as letters, words and/or logos, which are attached to the inside and/or the outside of walls, objects or supports.

The luminous advertisements are composed of a luminous advertisement assembly which forms a suitably shaped housing having a transparent or translucent front cover that is connected to a side wall of the assembly. Typically, the luminous advertisement also has a rear wall connected to the side walls, so that electronics and light sources are located in an enclosed inner space of the assembly, where they are protected from weather conditions, contamination and other environmental influences.

The front cover is connected to the side wall using a profiled connecting element which is glued to the edge region of the front plate and is generally referred to as trim cap.

From EP 2 997 565 A1, for example, it is known that the trim cap can have a contact region that rests on an outer surface of the front cover, or that the trim cap can be configured in the form of a so-called F-section and have a slot for receiving the edge region of the front cover. In either case, it is necessary and usual to glue the trim cap to the front plate or to (chemically) weld it thereto using a solvent.

This is a disadvantage because, in addition to the additional material consumption in the form of glue, special gluing devices are needed to spread a certain amount of glue over the lower surface of the U-shaped or V-shaped receptacle in a controlled manner so that, after bonding to the front plate, the glue will not be pressed back onto the visible surface of the front plate and a stable and uniform bond is created between the front plate and the trim cap. In the process, the surface provided with glue must be pressed onto the desired surface of the front plate to be connected until the glue is cured and the surfaces are bonded together. This is aggravated by the fact that the trim cap must be laid along curved and angled contours with acute and obtuse angles, as is the case with the letters "a" and "x", for example. In this connection, the trim cap must hold stably to the side wall and front plate at each point along the contour of the body and ultimately yield a visually appealing appearance by being laid as continuously as possible along the contour of the body, without discontinuities due to cuts.

SUMMARY

In an embodiment, the present invention provides a luminous advertisement assembly which includes a side wall, a transparent and/or translucent front plate and a profiled connecting element. The profiled connecting element has a first connecting region to which the front plate is fixed, and a second connecting region to which the side wall is fixed. The first connecting region is configured as a receptacle having a first leg and a second leg between which the front plate is received. A latching hook is disposed on the first leg and is configured to fix the front plate in the receptacle. A recess is disposed in the front plate, and the latching hook of the profiled connecting element engages in the recess of the front plate.

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 2:
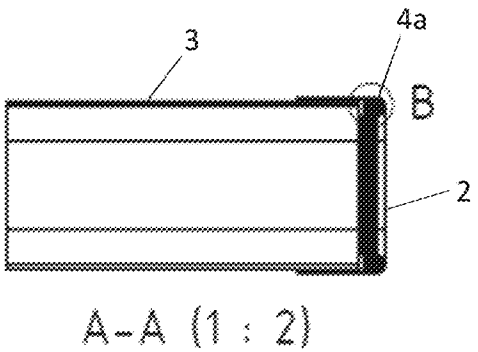
FIG. 2 is a sectional view taken along line A-A of FIG. 1 through a luminous advertisement assembly according to the invention.

Embodiments of the present invention provide a luminous advertisement assembly and a luminous advertisement that overcome the above disadvantages.

The above disadvantages are overcome according to an embodiment of the present invention by a luminous advertisement assembly, in which a latching hook is provided on the first leg to fix the front plate in the receptacle formed by the first and second legs, the ends of the legs bounding an entry opening. Thus, the front plate is interlockingly connected to the profiled connecting element, and thus to the side wall, without the use of glues. The latching hook may be disposed directly at an end of the leg or slightly set back therefrom within the receptacle formed by the two legs. The latching hook may extend in the longitudinal direction along the entire length of the profiled connecting element, and may therefore be configured as a latching lip, or may only be provided at discrete points of the profiled connecting element. If the latching hook extends along the entire length of the profiled connecting element, it also provides for sealing and thus for protection against weather conditions.

In a preferred embodiment of the invention, the luminous advertisement assembly has a recess, such as a groove, in the front plate, and the latching hook of the profiled connecting element engages in the recess of the front plate. The recess may be formed into the front plate in a simple manner using a tool, such as by milling. Due to the engagement of the latching hook, a particularly secure connection is created between the profiled connecting element and the front plate.

In a preferred embodiment of the invention, the latching hook of the luminous advertisement assembly is disposed in a barb-like manner. To this end, the latching hook may in particular have an angle of less than 90° with respect to the direction of insertion of the front plate into the receptacle. The direction of insertion may be defined in particular by the orientation of the front plate and/or legs and may be substantially parallel to the front plate and legs. The direction of insertion points into the interior of the receptacle and, therefore, corresponds to the direction of movement of the front plate during insertion into the receptacle. The direction of the latching hook is defined to be from its end that is fixed at the leg toward the free end. The angle between the latching hook and the direction of insertion is therefore defined such that an angle of 0° corresponds to a parallel arrangement and an angle of 180° corresponds to an anti-parallel arrangement. Thus, the latching hook is directed at an acute angle into the interior of the receptacle. During insertion of the front plate into the receptacle, the latching hook is moved by the front plate in the direction of insertion and thus pivoted out of the area of the front plate. If the front plate is moved in the opposite direction, such as occurs when the front plate is withdrawn from the receptacle, the latching hook is pivoted in a direction opposite to the direction of insertion and thus pressed against the front plate. This prevents, or at least hinders, the removal of the front plate and, therefore, the front plate is firmly held in the receptacle.

In another preferred embodiment of the invention, at least one leg of the receptacle is disposed parallel or inclined to the front plate. Parallel legs provide for particularly precise alignment of the front plate and fit snugly and compactly against the surfaces thereof. In contrast, if the, or one of the, legs are/is inclined to the front plate, the legs touch the front plate only at one end and thus clamp the front plate in the receptacle. At least one of the legs may also be curved so that the legs fit around the front plate and fix it in the manner of a gripper.

In a further preferred embodiment of the invention, a stiffening insert, in particular a metal foil, preferably an aluminum foil, is provided in the profiled connecting element. This provides a more stable profiled connecting element and prevents or limits a thermally induced dimensional change of the profiled connecting element, which may otherwise occur, for example, due to the heat released by a light source during operation of the luminous advertisement. The stiffening insert may be disposed, for example, between the first and second legs and thus provide a stronger clamping force between the first and second legs. The front plate is thus held particularly firmly in the receptacle.

In a particularly preferred embodiment of the invention, the stiffening insert extends from the first connecting region to the second connecting region. In particular, the stiffening insert may extend through the outer leg of the first connecting region and into and through the second connecting region. The stiffening insert may be curved within the leg to provide for a particularly efficient application of force on the front plate and thus for a stable clamping of the front plate between the legs.

In another preferred embodiment of the invention, a second latching hook is provided on the second leg. Thus, the holding force generated by the latching hook is produced on both sides of the front plate and provides for particularly secure holding of the front plate in the receptacle. In particular, a separate recess may be provided in the front plate for each latching hook, the recesses being disposed on opposite sides of the front plate, respectively.

In a further preferred embodiment of the invention, the profiled connecting element is at least partially made from cellulose acetate butyrate (CAB). This material has a particularly high resistance to chemicals and stress cracking and is particularly suitable for technical applications, in particular luminaires. The material is extremely impact-resistant, has good transparency and a high surface gloss. In addition, it is very weather-resistant and has good electrical insulation properties.

In another preferred embodiment of the invention, the latching hook includes the same material as the profiled connecting element and/or contains an elastic material, an anti-slip material and/or a thermoplastic elastomer. If the hook is made of a different material than the remainder of the profiled connecting element, then the profiled connecting element can be produced particularly easily in a co-extrusion process.

In yet another preferred embodiment of the invention, at least one leg is provided with an anti-slip coating on its side facing the front plate. Since this leg rests with the anti-slip coating against the front plate, the front plate is fixed in the receptacle between the two legs. In particular, if the leg and the latching hook are arranged such that the front plate is pressed against the anti-slip coating, a very high holding force is generated and the front plate is securely held. The anti-slip coating may have a substantially constant thickness, be serrated, round and/or formed integrally with the latching hook and may rest against the front plate in areal or point contact therewith or along a contact line. Depending on the location of use and material combination, the shape of the anti-slip coating can be selected such that a particularly strong holding force is generated.

In a further preferred embodiment of the invention, the front plate is received with its edge region, in particular with its peripheral edge, in the receptacle of the profiled connecting element and is connected via the profiled connecting element to the side wall along substantially its entire perimeter. Therefore, the luminous advertisement assembly forms a housing for a luminous advertisement that can be readily assembled from a few parts.

In another preferred embodiment of the invention, the side wall is fixed to the second connecting region by gluing, by means of a double-sided adhesive tape, by means of a magnetic adhesive tape, by chemical welding, latched engagement, screwing or riveting. A suitable joining technique for the connection between the profiled connecting element and the side wall can be selected depending on the location of use.

In a particularly preferred embodiment of the invention, the side wall is latched to the second connecting region by a hook of the second connecting region engaging with a folded edge or a nose of the side wall. Such a mechanical connection can be readily made and, in particular, is reversible. The front wall and the side wall can therefore be easily separated for repair purposes.

In another particularly preferred embodiment of the invention, the second connecting region is configured as a receptacle having a first leg and a second leg between which the side wall is received. A latching hook for fixing the side wall is provided on the first leg and/or on the second leg of the second connecting region. Therefore, the second connecting region may be configured substantially as described above for the first connecting region.

An embodiment of the invention is also achieved by a luminous advertisement including a luminous advertisement assembly as described above, a rear wall connected to the side wall of the luminous advertisement assembly, the front plate, the side wall and the rear wall forming a substantially enclosed inner space, and a lighting device disposed in the inner space. The lighting device may be directed toward the front plate, the side wall and/or the rear wall.

Figure 1:
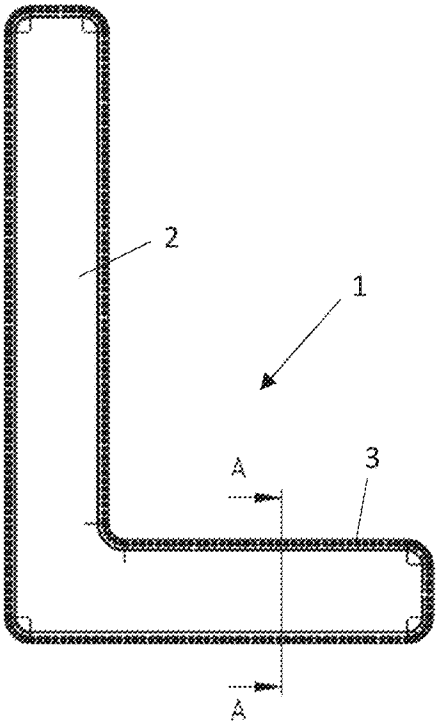
FIG. 1 is a plan view of an inventive luminous advertisement assembly in the shape of the letter "L"

FIG. 1 shows, in top view, a luminous advertisement assembly 1 in the shape of the letter "L". Luminous advertisement assembly 1 has an L-shaped front plate 2 and a side wall 3, which is arranged circumferentially around front plate 2 and connected thereto at the outer edge thereof.

FIG. 2 shows the luminous advertisement assembly of FIG. 1 in a sectional view taken along line A-A. Front plate 2 is connected at each of its two opposite outer edges by a profiled connecting element 4*a* to the respective region of side wall 3.

Figure 3:
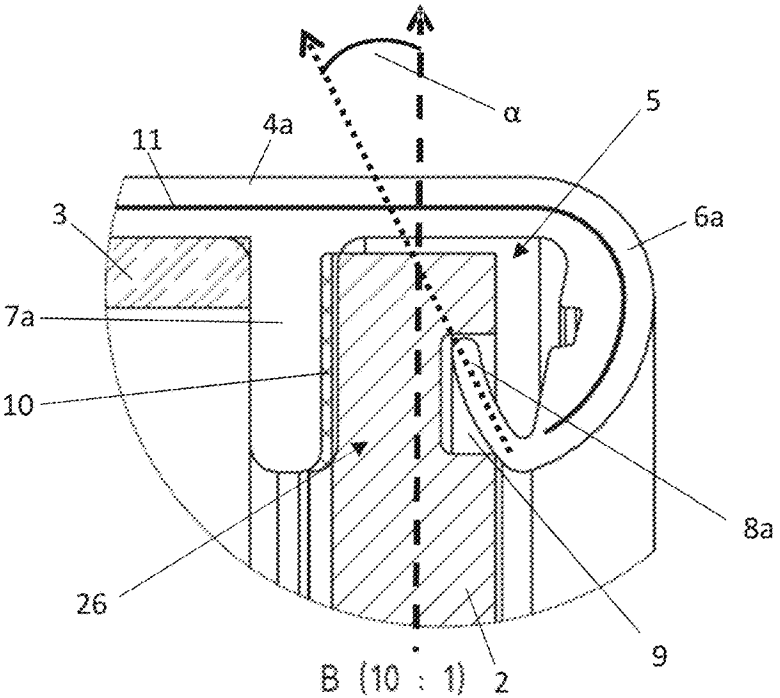
FIG. 3 is an enlarged view of the detail B of the sectional view of FIG. 2.

The details of the connection are apparent from the enlarged detail B shown in FIG. 3. Front plate 2 is received with its outer edge in a receptacle 26, which forms the first connecting region 5 of profiled connecting element 4*a*. Receptacle 26 includes essentially two legs 6*a*, 7*a*, the ends of the legs 6*a*, 7*a* bounding an entry opening for inserting the outer edge of front plate 2 into receptacle 26. Front plate 2 is received between legs 6*a*, 7*a*. Front plate 2 has a recess 9 which is configured as a simple groove and in which engages a latching hook 8*a* of profiled connecting element 4*a*. Latching hook 8*a* is arranged in a barb-like manner on a first leg 6*a* and directed into the interior of receptacle 26 in the direction of insertion of front plate 2. A plane which is shown as a dashed line in FIG. 3 and represents the direction of insertion and extends parallel to front plate 2 forms an angle $\alpha$ of less than 90° with a latching hook plane which is shown as a dotted line in FIG. 3 and represents the direction of the latching hook. The angle under consideration is defined between the direction of insertion of the front plate and the direction of the latching hook from the fixed end to the free end, so that an angle of 0° corresponds to a parallel arrangement and an angle of 180° corresponds to an anti-parallel arrangement.

When inserting front plate 2 into the recess 26 formed by leg 6*a* and leg 7*a*, front plate 2 presses against latching hook 8*a*, thereby causing it to flex away toward leg 6*a* and thus clear the space for insertion of front plate 2 into receptacle 26. Once front plate 2 is completely received in receptacle 26, latching hook 8*a* can spring back into recess 9 of front plate 2, whereby front plate 2 is securely held in receptacle 26. Second leg 7*a* is provided on its side facing front plate 2 with an anti-slip coating 10 which rests against the front plate and thus prevents displacement of front plate 2. Latching hook 8*a* and first leg 6*a* are arranged in such a way that they press front plate 2 against second leg 7*a* and thus against anti-slip coating 10, so that a particularly good holding force is generated.

Figure 4:
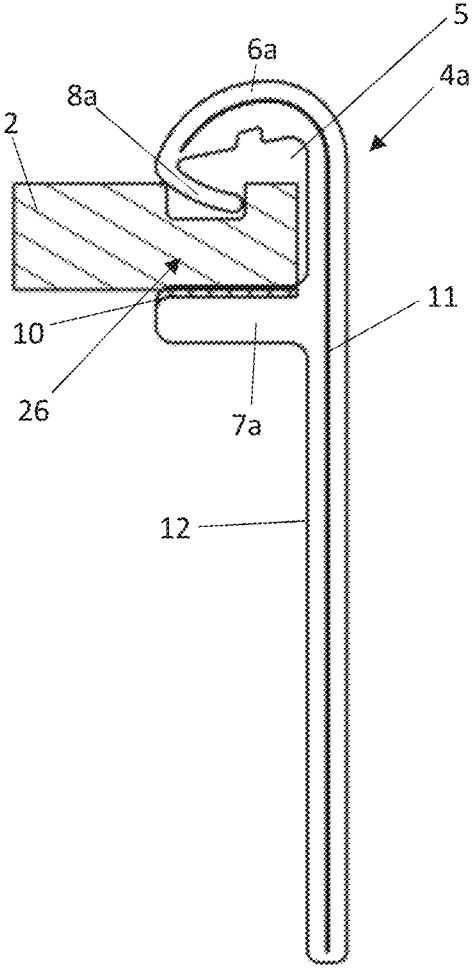
FIG. 4 is a sectional view of a profiled connecting element and a front plate of a luminous advertisement assembly according to the invention.

In FIG. 4, the profiled connecting element 4*a* of the first embodiment illustrated in FIG. 3 is shown entirely in section. In a direction perpendicular to the drawing plane, profiled connecting element 4*a* extends substantially constantly with the width shown. In addition to the two legs 6*a*, 7*a* that form the receptacle 26 for front plate 2, profiled connecting element 4*a* also has a second connecting region 12, so that profiled connecting element 4*a* is essentially F-shaped in configuration. Second connecting region 12 is connected to the side wall 3, as indicated in FIG. 3.

Provided within profiled connecting element 4*a* is a stiffening insert 11 which is preferably in the form of an aluminum foil and which extends within profiled connecting element 4*a* integrally through second connecting region 12 to first connecting region 5 and into first leg 6*a*. First leg 6*a* and the stiffening insert 11 disposed therein have a curved structure so that first leg 6*a* and stiffening insert 11 together exert a spring force against front plate 2 and thus against second leg 7*a*. Due to the integral connection of stiffening insert 11 between first connecting region 5 and second connecting region 12, first connecting region 5 is stiffened with respect to second connecting region 12, thus preventing the possibility of movement between front plate 2 and side wall 3 being caused by bending of profiled connecting element 4*a*.

In FIGS. 3 and 4, first leg 6*a* of first connecting region 5, which carries latching hook 8*a*, is the leg that rests against the outer surface of front plate 2 of the luminous advertisement assembly. It is understood to be within the scope of the invention that latching hook 8*a* may conversely be disposed on the leg of first connecting region 5 that rests against the inner surface of front plate 2. The same applies analogously to all other embodiments according to FIGS. 5 through 7 and 9 through 16. An example of such an embodiment with an inner first leg 6*e* is shown in FIG. 8.

Figure 5:
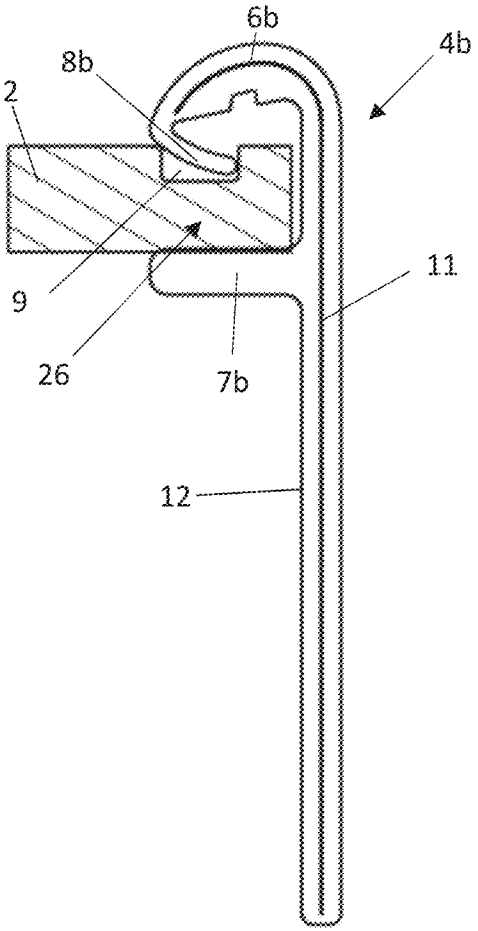
FIG. 5 is a sectional view of a profiled connecting element and a front plate of a second embodiment of the inventive luminous advertisement assembly.

The second embodiment of a profiled connecting element 4*b*, shown in FIG. 5, corresponds substantially to the first embodiment shown in FIG. 4, but does not have an anti-slip coating 10 on second leg 7*b*. First leg 6*b* and latching hook 8*b* correspond to first leg 6*a* and latching hook 8*a* of the first embodiment. A holding force sufficient to fix front plate 2 in receptacle 26 is generated by latching hook 8*b* alone, which engages in recess 9 of front plate 2. However, the entire profiled connecting element 4*b* may be made from a material having anti-slip properties.

Figure 6:
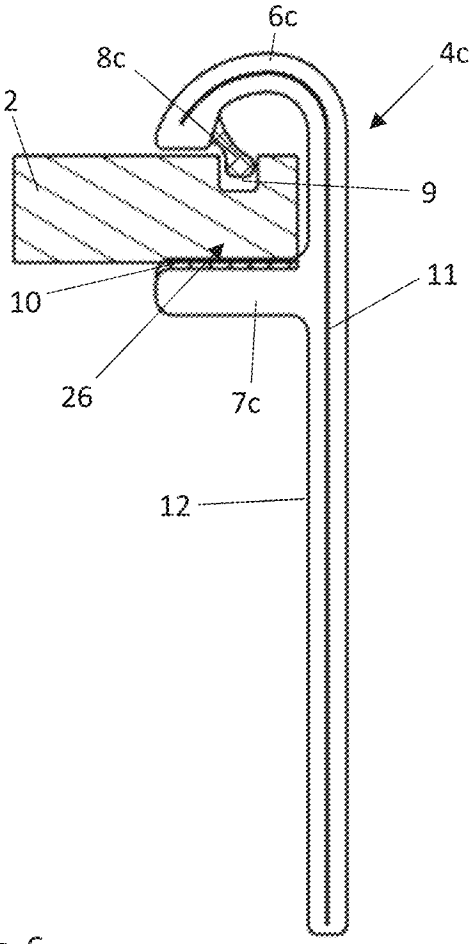
FIG. 6 is a sectional view of a profiled connecting element and a front plate of a third embodiment of the inventive luminous advertisement assembly.

A profiled connecting element 4*c* of a third embodiment is shown in FIG. 6 and also corresponds substantially to the first embodiment of FIG. 4. However, latching hook 8*c* is not made of the same material as the remainder of profiled connecting element 4*c*, but is composed of an elastically deformable material that is preferably softer than the material of the remainder of the profiled connecting element and/or has anti-slip properties. Latching hook 8*c* has a taper in its middle region, so that it can easily move out of the way when front plate 2 is inserted into receptacle 26 of first connecting region 5. At its free end, latching hook 8*c* has a widened portion that engages in the recess 9 or groove of front plate 2. Front plate 2 is thus held in receptacle 26 of profiled connecting element 4*c* in three ways. Latching hook 8*c* engages form-fittingly in recess 9 of front plate 2, latching hook 8*c* rests with its anti-slip material in recess 9 of front plate 2 and thus ensures a friction fit, and front plate 2 rests against an anti-slip coating 10 on second leg 7*c* of profiled connecting element 4*c* and is therefore also held thereon by a friction fit. The latching hook is fixed at leg 6*c* in the region of an undercut. When the connection between front plate 2 and profiled connecting element 4*c* is released, latching hook 8*c* is deformed, its free end coming to rest against the end of leg 6*c*, so that the entry opening formed between the ends of legs 6*c* and 7*c* is partially blocked, thereby making it considerably more difficult to completely remove the front plate from receptacle 26.

Figure 7:
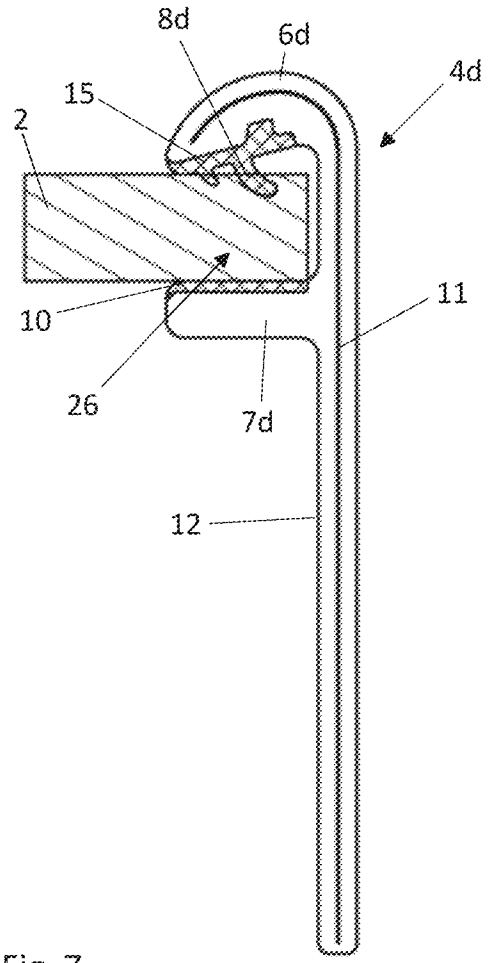
FIG. 7 is a sectional view of a profiled connecting element and a front plate of a fourth embodiment of the inventive luminous advertisement assembly.
Figure 8:
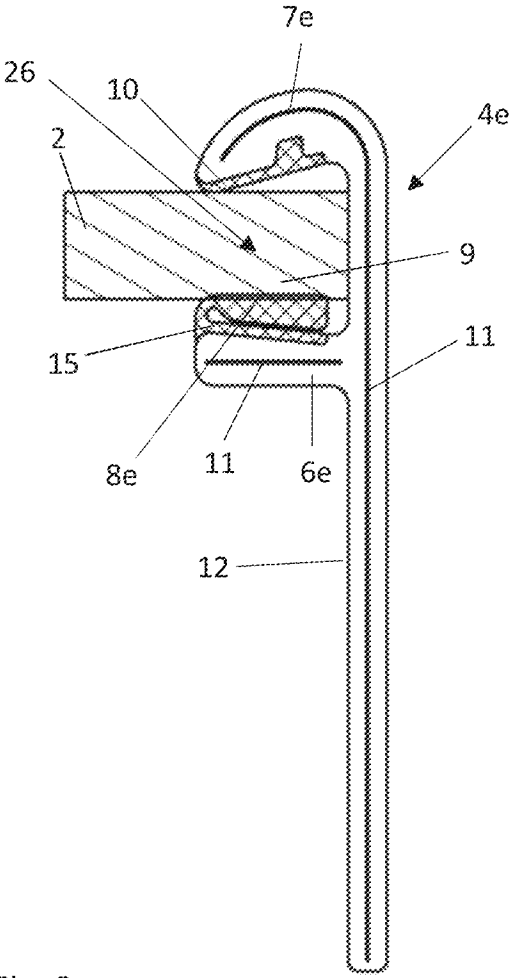
FIG. 8 is a sectional view of a profiled connecting element and a front plate of a fifth embodiment of the inventive luminous advertisement assembly.

A profiled connecting element 4*c* of a fourth embodiment is shown in FIG. 7 and corresponds substantially to the first embodiment of FIG. 4, but has a latching hook 8*d* in the form of a double latching hook. Latching hook 8*d* has a first latching hook portion and a second latching hook portion that is located further away from the entry opening of receptacle 26 and is preferably larger than the first latching hook portion. Furthermore, the double latching hook is formed integrally with an anti-slip coating 15 on first leg 6*d*. Front plate 2 does not have a recess or groove in which double latching hook 8*d* could engage. Instead, the double latching hook rests with both portions against the surface of the front plate, whereby front plate 2 is frictionally held in receptacle 26. The combination of double latching hook 8*d* with anti-slip coating 15 on first leg 6*d* and anti-slip coating 10 on second leg 7*d* ensures that front plate 2 is held in profiled connecting element 4*d*. In a departure from the embodiment according to FIG. 7, a groove 9 may be provided in front plate 2 also in the case of a double latching hook.

A profiled connecting element 4*e* of a fifth embodiment is shown in FIG. 8 and corresponds substantially to the first embodiment of FIG. 4, but has a first leg 6*e* with a latching hook 8*e* that forms an inner leg 6*e* on the side of receptacle 26 facing second connecting region 12. Second leg 7*e* is disposed at the outer side of profiled connecting element 4*e* on the side of receptacle 26 facing away from second connecting region 12 and has an anti-slip coating 10 on its side facing front plate 2. Latching hook 8*e* is made of an anti-slip material and integrally connected to a coating 15 on first leg 6*e*. A taper is formed at the junction between latching hook 8*e* and coating 15 so that latching hook 8*e* can be easily pivoted during insertion of front plate 2. On the side facing front plate 2, latching hook 8*e* has a substantially flat surface which, when front plate 2 is inserted, rests flat thereagainst. On the side facing away from the front plate, latching hook 8*e* also has a substantially flat surface, which rests against coating 15. Accordingly, front plate 2 is held on first leg 6*e* by two frictional connections. On the side facing coating 15, latching element 8*e* may preferably have a surface having good slip properties, so that overall the friction between the facing surfaces of latching element 8*e*, on the one hand, and coating 15, on the other, is low. Such slip properties may be obtained, for example, by a suitable coating. The two surfaces of latching hook 8*e* are disposed at an angle to each other, so that the latching hook has a wedge shape that tapers in a direction opposite to the direction of insertion. When withdrawing front plate 2 from receptacle 26, latching hook 8*e* is also moved in a direction opposite to the direction of insertion due to the frictional connection between latching hook 8*e* and front plate 2. Because of the wedge shape of latching hook 8*e*, a force transverse to the direction of insertion is exerted on front plate 2 so that it is clamped between first leg 6*e* and second leg 7*e*. Stiffening insert 11 extends from second connecting region 12 to second leg 7*e*, which forms the outer leg. Moreover, stiffening insert 11 has a separate portion in first leg 6*e*, the separate portion not being connected to the part of stiffening insert 11 that extends from second connecting region 12 to outer leg 7*e* However, stiffening insert 11 may also be formed integrally in first leg 6*e*, second leg 7*e* and/or in second connecting region 12. In a departure from the embodiment according to FIG. 8, a groove 9 may be provided in front plate 2 also in the case of a latching hook 8*e* according to FIG. 8.

Figure 9:
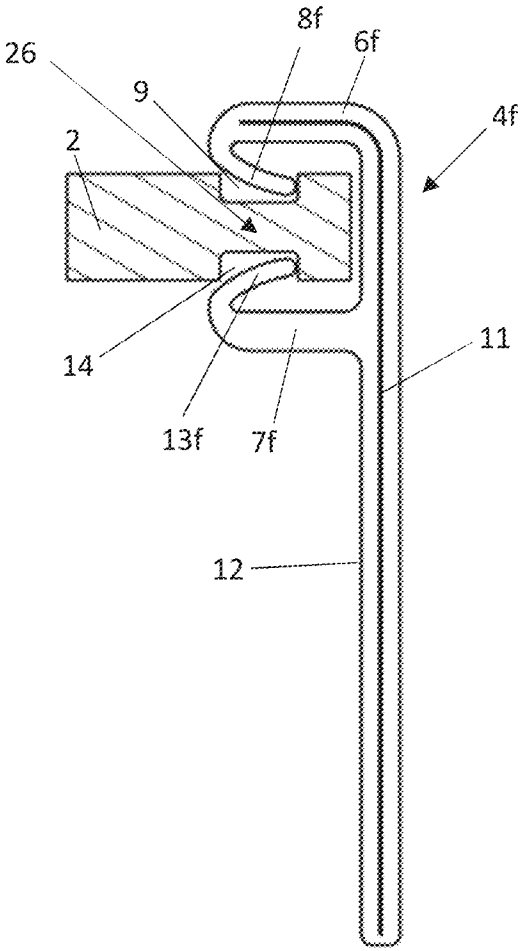
FIG. 9 is a sectional view of a profiled connecting element and a front plate of a sixth embodiment of the inventive luminous advertisement assembly.

A profiled connecting element 4*f* of a sixth embodiment is shown in FIG. 9 and corresponds substantially to the first embodiment shown in FIG. 4, but has a first leg 6*f* that is substantially flat and parallel to second leg 7*f* and front plate 2, and thus to the direction of insertion. In addition to recess 9, front plate 2 has a second recess 14 disposed on the opposite side of front plate 2. Profiled connecting element 4*f* has a second latching hook 13*f* formed on second leg 7*f* and engaging in recess 14 of front plate 2. Due to the double-latching connection by two latching hooks 8*f*, 13*f* in two recesses 9, 14 of front plate 2, a particularly stable connection is obtained.

Figure 10:
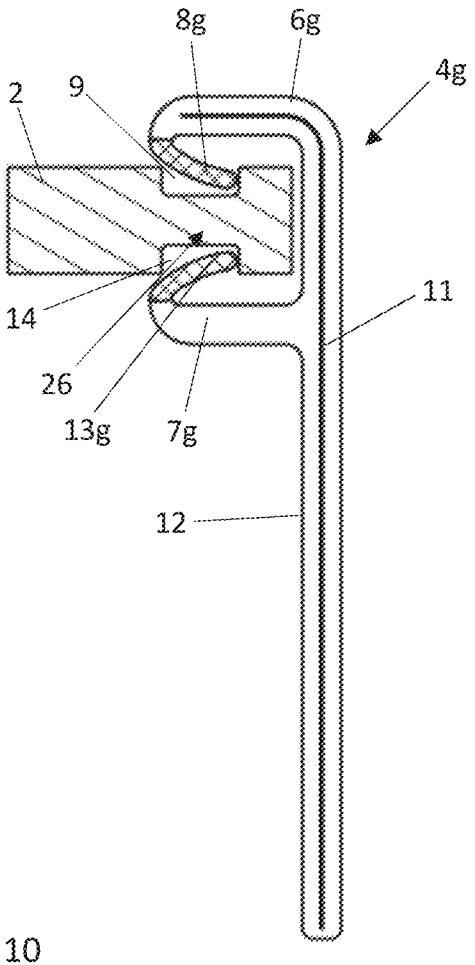
FIG. 10 is a sectional view of a profiled connecting element and a front plate of a seventh embodiment of the inventive luminous advertisement assembly.

FIG. 10 shows a seventh embodiment of the invention which corresponds substantially to the sixth embodiment (see FIG. 9), but has latching hooks 8*g*, 13*g* which are formed from a material that is preferably softer than the material of the remainder of the profiled connecting element and in particular has anti-slip properties. Therefore, front plate 2 is held in receptacle 26 both form-fittingly and fictionally.

Figure 11:
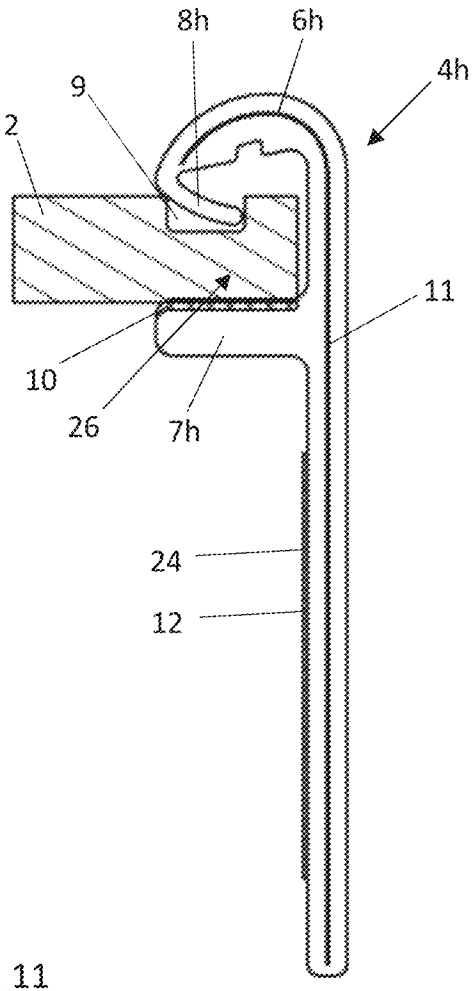
FIG. 11 is a sectional view of a profiled connecting element and a front plate of an eighth embodiment of the inventive luminous advertisement assembly.

FIG. 11 shows an eighth embodiment of the invention which corresponds substantially to the first embodiment of FIG. 4, but has a double-sided adhesive tape 24 in second connecting region 12 to connect the same to side wall 3 of luminous advertisement assembly 1. Double-sided adhesive tape 24 may have a protective film that can be removed prior to bonding to a side wall 3 so as to expose the adhesive surface and bond it to side wall 3.

Figure 12:
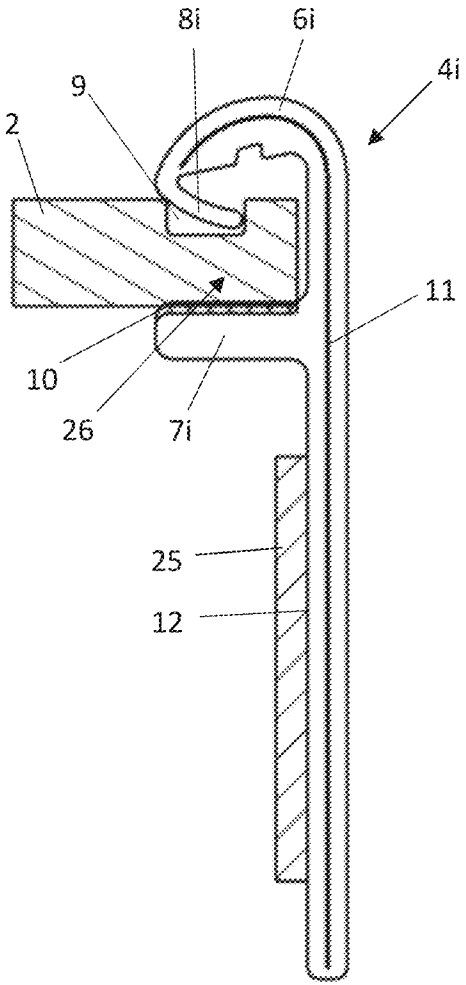
FIG. 12 is a sectional view of a profiled connecting element and a front plate of a ninth embodiment of the inventive luminous advertisement assembly.

FIG. 12 shows a ninth embodiment of the invention which corresponds substantially to the first embodiment of FIG. 4, but has a magnetic adhesive tape 25 in second connecting region 12 to connect the same to side wall 3. Magnetic adhesive tape 25 is bonded to profiled connecting element 4*i* and can be reversibly connected to a ferromagnetic side wall 3. This allows front plate 2 to be very easily removed together with profiled connecting element 4*i* from side wall 3, for example to replace the light source or to make repairs, because the connection between side wall 3 and front plate 2 does not need to be separated by removing screws, rivets, glue, or the like.

Figure 13:
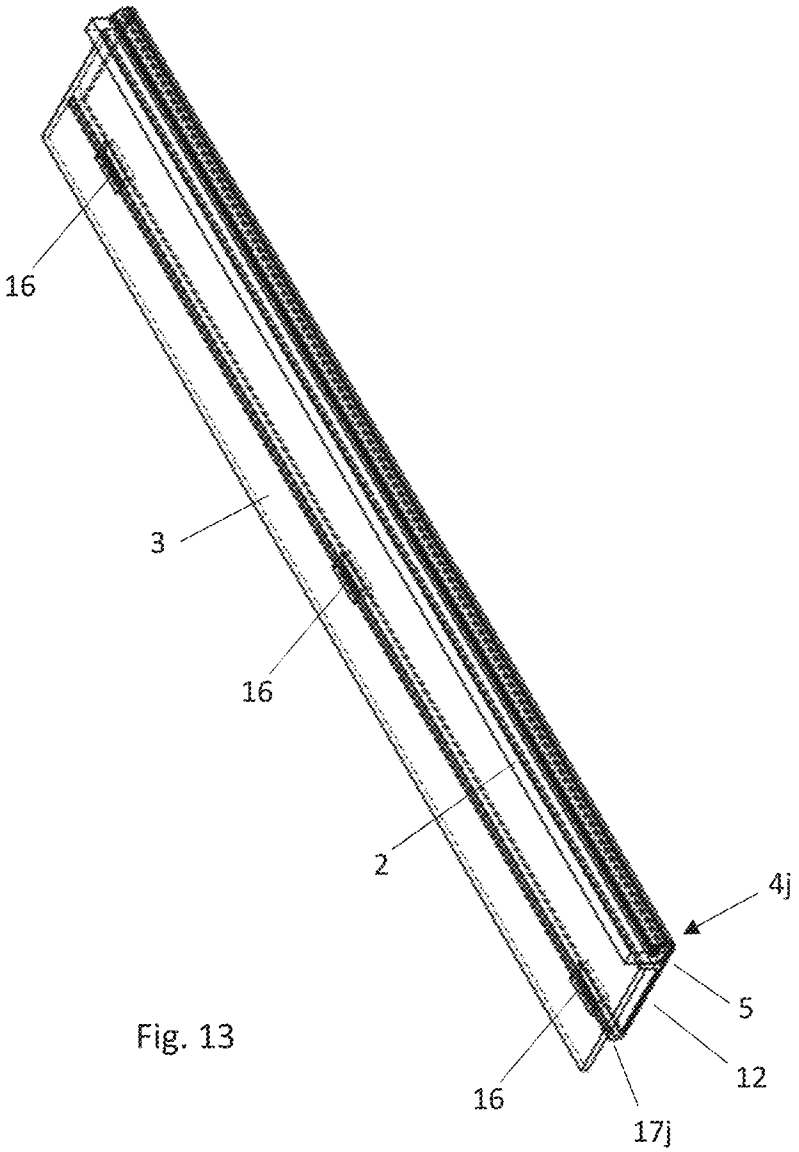
FIG. 13 is an oblique plan view of a tenth embodiment of the luminous advertisement assembly according to the invention.

FIG. 13 shows an oblique top view of a tenth embodiment of the invention, looking at the inner side of side wall 3. Front plate 2 is received along its entire length in receptacle 26 of first connecting region 5 between the two legs 6*j*, 7*j*. Side wall 3 is provided at regular intervals with noses 16, with which engages a hook 17*j* of second connecting region 12.

Figure 14:
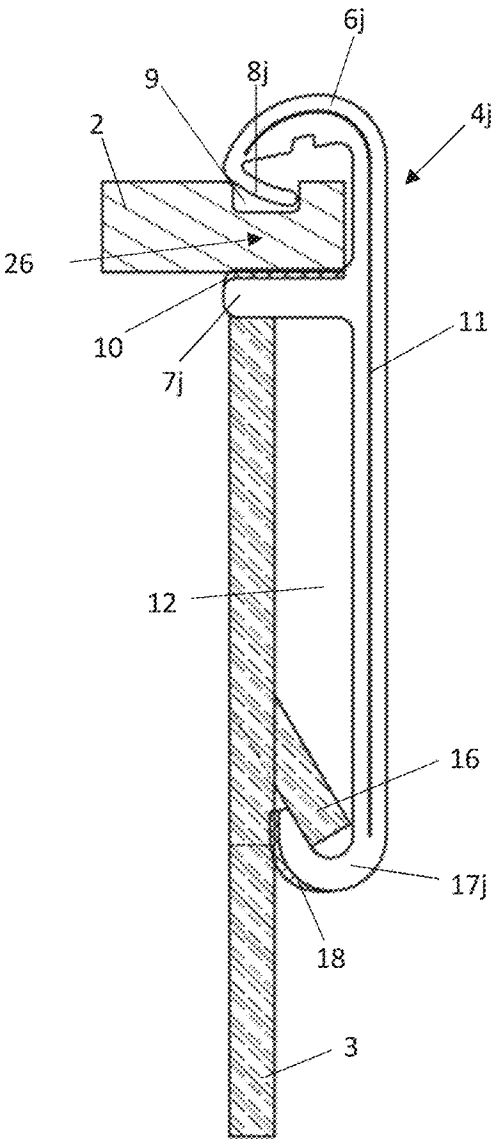
FIG. 14 is a sectional view of the tenth embodiment.

FIG. 14 shows a corresponding sectional view of the tenth embodiment at the position of one of the noses 16. Legs 6*j*, 7*j* and latching hook 8*j* correspond to the respective parts of the first embodiment of FIG. 4. Side wall 3 rests with its edge against the side of second leg 7*j* that faces away from front plate 2. Nose 16 is oriented in a direction away from this edge, so that a hook 17*j* of second connecting region 12 can engage with it and latch profiled connecting element 4*j* to side wall 3. The region of hook 17*j* of second connecting region 12 that rests against side wall 3 is provided with an anti-slip coating 18, which provides an improved grip between hook 17*j* and nose 16.

Figure 15:
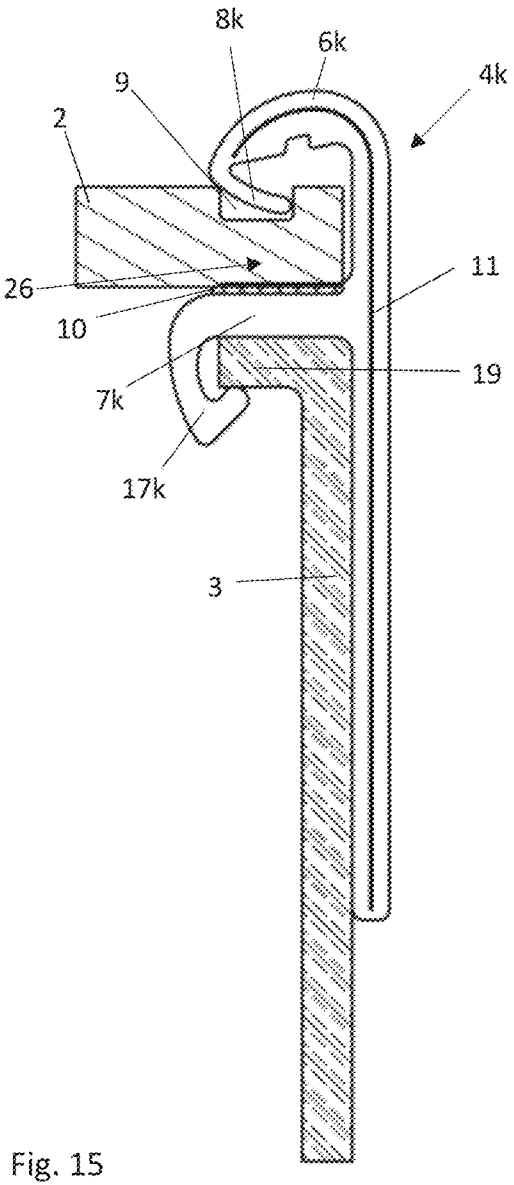
FIG. 15 is a sectional view of a profiled connecting element and a front plate of an eleventh embodiment of the inventive luminous advertisement assembly.

FIG. 15 shows an eleventh embodiment of the invention in which side wall 3 has a folded edge 19, which is formed by simply bending the side wall in the edge region. Hook 17*k* of second connecting region 12 is fixed at second leg 7*k* and engages with folded edge 19 of side wall 3 to connect it to profiled connecting element 4*k*.

Figure 16:
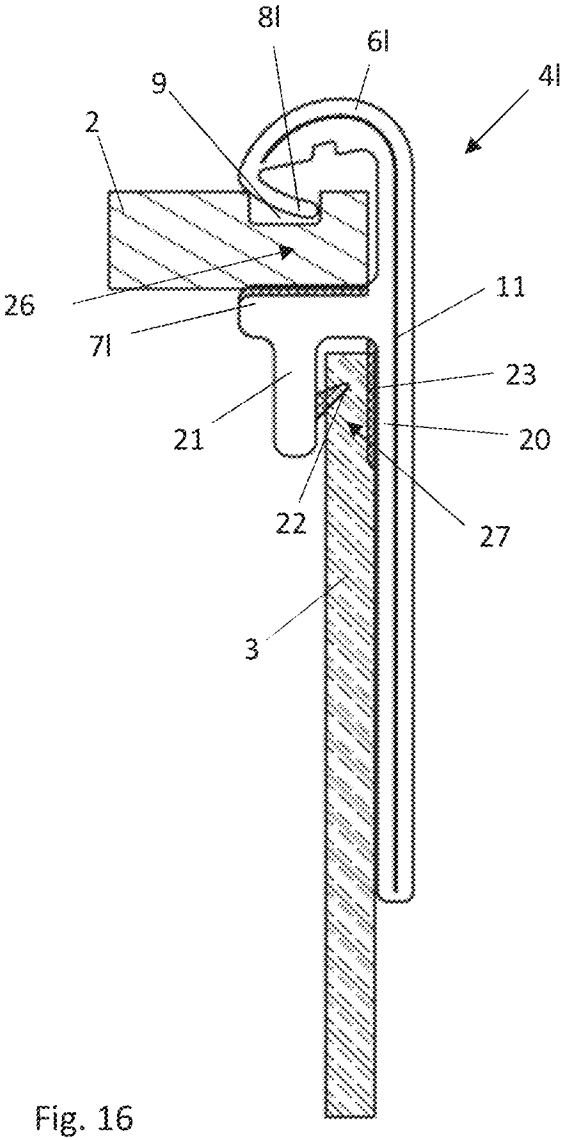
FIG. 16 is a sectional view of a profiled connecting element and a front plate of a twelfth embodiment of the inventive luminous advertisement assembly.

In a twelfth embodiment of the invention, shown in FIG. 16, second connecting region 12 is configured comparably to first connecting region 5 and has a receptacle 27 formed by a first leg 20 of second connecting region 12 and a second leg 21 of the second connecting region 12. Second leg 21 of second connecting region 12 is formed on second leg 71 (i.e. the inner leg) of first connecting region 5. Second leg 21 of second connecting region 12 is provided with a latching hook 22 which is disposed in a barb-like manner to hold side wall 3 in receptacle 27 of second connecting region 12. In addition, first leg 20 is provided with an anti-slip coating 23 which provides for increased holding force in the same way as described for first connecting region 5. In a departure from the embodiment according to FIG. 16, side wall 3 may be provided with a recess with which latching hook 22 cooperates.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

TABLE OF REFERENCE CHARACTERS

1 luminous advertisement assembly
2 front plate
3 side wall
4*a*-1 profiled connecting element
5 first connecting region
6*a*-1 first leg
7*a*-1 second leg
8*a*-1 latching hook
9 recess
10 anti-slip coating of the second leg
11 stiffening insert
12 second connecting region
13*f, g* second latching hook
14 second recess
15 anti-slip coating of the first leg
16 nose
17*j, k* hook
18 anti-slip coating of the hook
19 folded edge
20 first leg of the second connecting region
21 second leg of the second connecting region
22 latching hook of the second connecting region
23 anti-slip coating of the second leg of the second connecting region
24 double-sided adhesive tape
25 magnetic adhesive tape
26 receptacle of the first connecting region
27 receptacle of the second connecting region
α angle

The invention claimed is:

1. A luminous advertisement assembly, comprising:
a side wall;
a transparent and/or translucent front plate; and
a profiled connecting element extending along a longitudinal direction, the profiled connecting element having, in cross-section, a first connecting region to which the front plate is fixed, and a second connecting region to which the side wall is fixed along a length of the profiled connecting element in the longitudinal direction, the first connecting region being configured as a receptacle having a first leg and a second leg between which the front plate is received,
wherein a latching hook is disposed on the first leg and is configured to fix the front plate in the receptacle, and
wherein a recess is disposed in the front plate, and the latching hook of the profiled connecting element engages in the recess of the front plate.

2. The luminous advertisement assembly according to claim 1, wherein the latching hook is disposed in a barb-like manner.

3. The luminous advertisement assembly according to claim 1, wherein at least one of the legs of the receptacle is disposed parallel or inclined to the front plate.

4. The luminous advertisement assembly according to claim 1, wherein a stiffening insert, in particular a metal foil, is disposed in the profiled connecting element.

5. The luminous advertisement assembly according to claim 4, wherein the stiffening insert extends from the first connecting region to the second connecting region.

6. The luminous advertisement assembly according to claim 1, wherein a second latching hook is disposed on the second leg.

7. The luminous advertisement assembly according to claim 1, wherein the profiled connecting element includes cellulose acetate butyrate.

8. The luminous advertisement assembly according to claim 1, wherein the latching hook includes a same material as the profiled connecting element, an elastic material, an anti-slip material and/or a thermoplastic elastomer.

9. The luminous advertisement assembly according to claim 1, wherein at least one of the legs has an anti-slip coating on a side facing the front plate.

10. The luminous advertisement assembly according to claim 1, wherein the front plate is received with an edge region of the front plate, in particular with a peripheral edge of the front plate, in the receptacle of the profiled connecting element and is connected via the profiled connecting element to the side wall along substantially an entire perimeter of the front plate.

11. The luminous advertisement assembly according to claim 1, wherein the side wall is fixed to the second connecting region by gluing, a double-sided adhesive tape, a magnetic adhesive tape, chemical welding, latched engagement, screwing or riveting.

12. The luminous advertisement assembly according to claim 11, wherein the side wall is latched to the second connecting region by a folded edge or a nose of the side wall, which engages a hook of the second connecting region.

13. The luminous advertisement assembly according to claim 1, wherein the second connecting region is configured as a receptacle having a first leg and a second leg between which the side wall is received, and wherein a latching hook for fixing the side wall is disposed on the first leg and/or on the second leg of the second connecting region.

14. A luminous advertisement comprising:

the luminous advertisement assembly according to claim 1;

a rear wall connected to the side wall of the luminous advertisement assembly, wherein the front plate, the side wall and the rear wall form a substantially enclosed inner space; and a lighting device disposed in the inner space.

15. The luminous advertisement assembly according to claim 1, further comprising a rear wall connected to the side wall of the luminous advertisement assembly, wherein the front plate, the side wall and the rear wall form a substantially enclosed inner space.

16. The luminous advertisement assembly according to claim 15, wherein the front plate is received with an edge region of the front plate in the receptacle of the profiled connecting element and is connected via the profiled connecting element to the side wall along substantially an entire perimeter of the front plate.

17. The luminous advertisement assembly according to claim 16, further comprising a lighting device disposed in the inner space.

18. The luminous advertisement assembly according to claim 1, wherein the front plate is received with an edge region of the front plate in the receptacle of the profiled connecting element along an entire extent of the profiled connecting element in the longitudinal direction, and wherein the side wall is received with an edge region of the side wall in the second connecting region of the profiled connecting element along the entire extent of the profiled connecting element in the longitudinal direction.

* * * * *